US009806408B2

(12) United States Patent
Sugimura et al.

(10) Patent No.: US 9,806,408 B2
(45) Date of Patent: Oct. 31, 2017

(54) ANTENNA AND METHOD FOR PRODUCING THE SAME

(71) Applicant: SK-Electronics Co., Ltd., Kyoto-shi (JP)

(72) Inventors: Shiro Sugimura, Kanazawa (JP); Kazuo Ogata, Kyoto (JP); Shoji Hashimoto, Kyoto (JP)

(73) Assignee: SK-Electronics Co., Ltd., Kyoto (JP)

( * ) Notice: Subject to any disclaimer, the term of this patent is extended or adjusted under 35 U.S.C. 154(b) by 98 days.

(21) Appl. No.: 14/766,146

(22) PCT Filed: Oct. 8, 2013

(86) PCT No.: PCT/JP2013/077383
§ 371 (c)(1),
(2) Date: Aug. 6, 2015

(87) PCT Pub. No.: WO2014/125674
PCT Pub. Date: Aug. 21, 2014

(65) Prior Publication Data

US 2015/0380808 A1 Dec. 31, 2015

(30) Foreign Application Priority Data

Feb. 13, 2013 (JP) ..... 2013-025476

(51) Int. Cl.
*H01Q 1/38* (2006.01)
*H01Q 9/36* (2006.01)
*H01Q 11/08* (2006.01)

(52) U.S. Cl.
CPC ..... *H01Q 1/38* (2013.01); *H01Q 9/36* (2013.01); *H01Q 11/08* (2013.01)

(58) Field of Classification Search
None
See application file for complete search history.

(56) References Cited

U.S. PATENT DOCUMENTS

| | | | | |
|---|---|---|---|---|
| 4,494,122 | A * | 1/1985 | Garay | H01Q 9/16 343/722 |
| 5,854,608 | A * | 12/1998 | Leisten | H01Q 1/242 343/821 |
| 5,995,065 | A | 11/1999 | Kitchener et al. | |
| 2010/0090824 | A1 | 4/2010 | Rowell et al. | |

FOREIGN PATENT DOCUMENTS

| | | | |
|---|---|---|---|
| JP | 6260828 | A | 9/1994 |
| JP | 1155024 | A | 2/1999 |
| JP | 200387044 | A | 3/2003 |
| JP | 2003152427 | A | 5/2003 |

(Continued)

*Primary Examiner* — Robert Karacsony
(74) *Attorney, Agent, or Firm* — The Webb Law Firm

(57) ABSTRACT

An antenna of the present invention includes a laminate body including a conductor core, an insulator layer, and a conductor pattern. The conductor pattern is a conductor layer formed of a conducting body disposed on a radially outer side of the insulator layer. The conductor core and the conductor pattern are connected to each other in such a manner that a current is made to flow in a direction from the conductor core to the conductor pattern or in a direction opposite thereto so as to coincide with a power supply direction.

8 Claims, 7 Drawing Sheets

(56) References Cited

FOREIGN PATENT DOCUMENTS

| | | | |
|---|---|---|---|
| JP | 200650213 | A | 2/2006 |
| JP | 200654655 | A | 2/2006 |
| JP | 200927741 | A | 2/2009 |
| JP | 201312209 | A | 1/2013 |
| TW | M435059 | U1 | 8/2012 |

* cited by examiner

ANTENNA AND METHOD FOR PRODUCING THE SAME

CROSS-REFERENCE TO RELATED APPLICATION

This application is the United States national phase of International Application No. PCT/JP2013/077383 filed Oct. 8, 2013, and claims priority to Japanese Patent Application No. 2013-025476 filed Feb. 13, 2013, the disclosures of which are hereby incorporated in their entirety by reference.

FIELD

The present invention relates to an antenna that enables information transmission and power supply between itself and a small-sized IC chip (especially a passive RFID tag) provided in a small-sized concave portion having a concave shape, and a method for producing the same.

BACKGROUND

In recent years, reduction in size of IC chips has proceeded. In such small-sized IC chips, an IC chip with an antenna mounted thereon is known (see Patent Literature 1, for example). The possibility of applying such a small-sized IC chip to various industries has been widely studied. A specific example for which study was made includes an application to a small-sized concave portion made of a metal having a narrow space (assembling which includes embedding or mounting). In this case, a small-sized IC chip (having a size of, for example, 0.5 millimeters×0.5 millimeters or smaller) is provided on a bottom part of a concave portion of a small-sized metal body and is configured to enable wireless communication (transmission and receiving of radio waves for writing and reading of information) between itself and a reader/writer.

Here, it is assumed that a good antenna efficiency is realized in the case where an antenna on the reader/writer side has a size substantially equal to the opening area of the antenna on the small-sized IC chip side. Unless the antenna on the reader/writer side is located in abutting contact with or in proximity to a small-sized IC chip within a small-sized concave portion, it is difficult to appropriately perform wireless communication between the antenna on the reader/writer side and the small-sized IC chip due to the influence of reflection or the like by a concaved wall surface, which may cause a trouble in information writing/reading. Thus, there is a demand for such a small-sized antenna as to match to an antenna on the small-sized IC chip side.

On the other hand, there is known a small-sized antenna of this type which includes a ground plate having a flat plate shape, a first core member provided on the ground plate and formed using a soft magnetic material having a columnar shape, and a wire wound in a spiral shape around the first core member (see Patent Literature 2, for example).

CITATION LIST

Patent Literature

Patent Literature 1: JP-2009-027741 A

Patent Literature 2: JP-2006-054655 A

SUMMARY

Technical Problem

However, it is not easy for the aforesaid conventional antenna to have such a small size as to enable itself to be in abutting contact with or in proximity to a small sized IC chip provided within a small-sized concave portion due to the configuration in which the first core member is attached to the ground plate and the wire is wound around the first core member. Thus, the conventional antenna had a problem in reducing the size.

Further, even if the antenna has a reduced size, an antenna performance may be lowered so that the transmission distance of radio waves is shortened and thus the distance within which communication can be made is shortened. Because of this, it is expected that wireless communication with a small sized IC chip may not be appropriately made. Thus, there was a problem in performing appropriate communication.

In view of the above problems, an object of the present invention is to provide an antenna that is capable of performing appropriate communication while being easily reduced in size, and a method for producing the same.

Solution to Problem

According to the present invention, there is provided an antenna comprising a laminate body configured so that a current is made to flow therethrough, thereby transmitting and receiving radio waves, the laminate body including: a conductor core formed of an elongated conducting body; an insulator layer formed of an insulating body disposed on a radially outer side of the conductor core; and a conductor pattern disposed on a radially outer side of the insulator layer and formed of a conducting body having such a shape that a power supply direction in which the current flows becomes a direction from one end side to the other end side in an axial direction or a direction opposite thereto, wherein the conductor pattern is a conductor layer formed of a conducting body disposed on the radially outer side of the insulator layer, and wherein the conductor core and the conductor pattern are connected to each other in such a manner that a current is made to flow in a direction from the conductor core to the conductor pattern or in a direction opposite thereto so as to allow its power supply direction to coincide with the aforesaid direction.

The antenna of the present invention may be configured so that the laminate body includes an outside insulator layer formed of an insulating body disposed on a radially outer side of the conductor pattern, and an outside conductor pattern disposed on a radially outer side of the outside insulator layer and formed of a conducting body having a certain shape which is the same as or substantially the same as the shape of the conductor pattern, and the outside conductor pattern is a conductor layer formed of a conducting body disposed on the radially outer side of the outside insulating body.

According to the present invention, there is also provided a method for producing an antenna including: a conductor pattern forming step of providing a conductor layer of a laminate body with a conductor pattern having such a shape that a power supply direction in which a current for power supply flows becomes a direction from one end side to the other end side in an axial direction or a direction opposite thereto, by irradiating the conductor layer with laser by a laser evaporation technique, the laminate body including a conductor core having an elongated conducting body, an insulator layer formed of an insulating body disposed on a radially outer side of the conductor core, and the conductor layer formed of a conducting body disposed on a radially outer side of the insulator layer; and a connection step of connecting the conductor core and the conductor pattern to each other in such a manner that a current is made to flow in a direction from the conductor core to the conductor pattern or in a direction opposite thereto so as to allow its power supply direction to coincide with the aforesaid direction.

According to the present invention, there is also provided a method for producing an antenna including: an outside conductor pattern forming step of providing an outside conduction layer with an outside conductor pattern having such a shape that a power supply direction in which a current for power supply flows becomes a direction from one end side to the other end side in an axial direction or a direction opposite thereto, by irradiating the outside conductor layer with laser by a laser evaporation technique, the laminate body including a conductor core formed of an elongated conducting body, an inside insulator layer formed of an insulating body disposed on a radially outer side of the conductor core, an inside conductor layer formed of an insulating body disposed on a radially outer side of the inside conductor layer, an outside insulator layer formed of an insulating body disposed on a radially outer side of the inside conductor layer, and the outside conductor layer formed of a conducting body disposed on a radially outer side of the outside insulator layer; an inside conductor pattern forming step of providing the inside conductor layer with an inside conductor pattern having a shape which is the same as or substantially the same as the shape of the outside conductor pattern by removing a part of the outside insulator layer and a part of the inside conductor layer, respectively, using wet etching with the outside conductor patter as a mask; and a connection step of connecting the conductor core and the inside conductor pattern to each other in such a manner that a current is made to flow in a direction from the conductor core to the inside conductor pattern or in a direction opposite thereto so as to coincide with a direction of a current which is made to flow for power supply from the one end side to the other end side in the axial direction of the inside conductor pattern.

The method of the present invention may be configured so that the conductor layer or the outside conductor layer is irradiated with laser along the nominal line on a radial side surface, while a irradiating means for irradiating laser or a laminate body is continuously rotated about an axis of a conductor core during laser irradiation using the laser evaporation technique in the conductor pattern forming step or the outside conductor pattern forming step.

DESCRIPTION OF EMBODIMENTS

A description will be hereinafter made for one embodiment of an antenna according to the present invention with reference to FIG. 1, FIG. 2A and FIG. 2B. An antenna 1 of the present embodiment is configured as a small-sized helical antenna, and is to be mounted in a reader/writer 10 for wireless communication with an IC chip using radio waves, as shown in FIG. 1.

Figure 1:
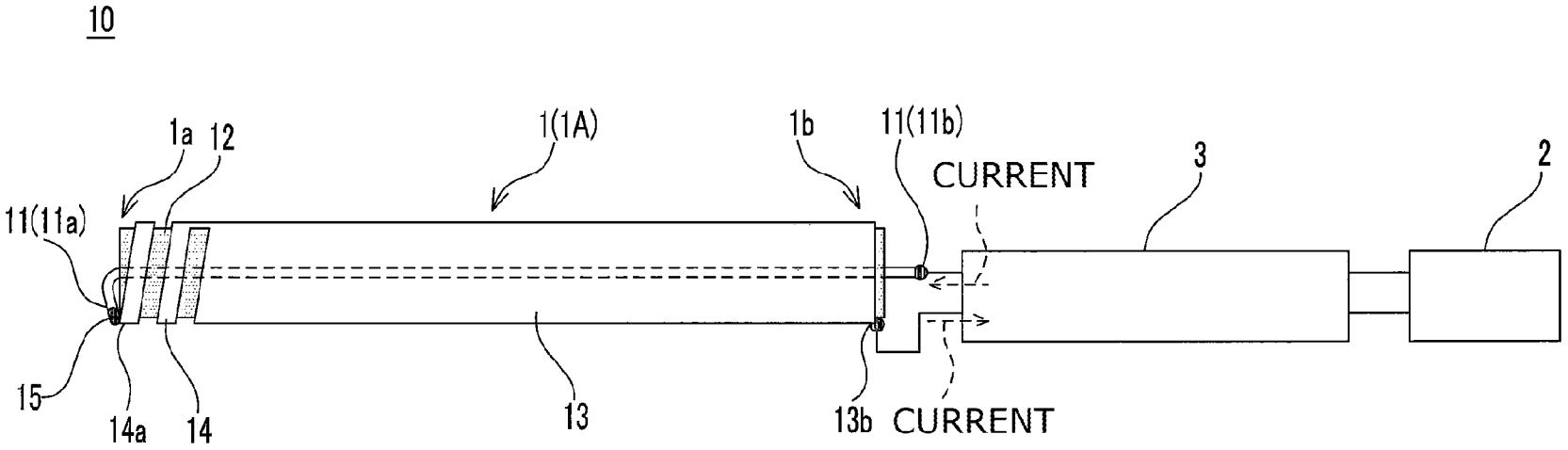
FIG. 1 is a conceptual diagram showing a configuration of a reader/writer provided with an antenna that is one embodiment of the present invention.

The reader/writer 10 includes a body part 2 that generates an information signal containing certain information relating to an IC chip and a power supply signal for supplying electric power to the IC chip, and the antenna 1 that is connected to the body part 2 via a matching circuit 3 (see FIG. 1). The matching circuit 3 is designed to achieve impedance matching and also functions as a bandpass filter. Specifically, the matching circuit is an LC circuit and may be configured as a Π type circuit or a T type circuit.

Figure 2A:
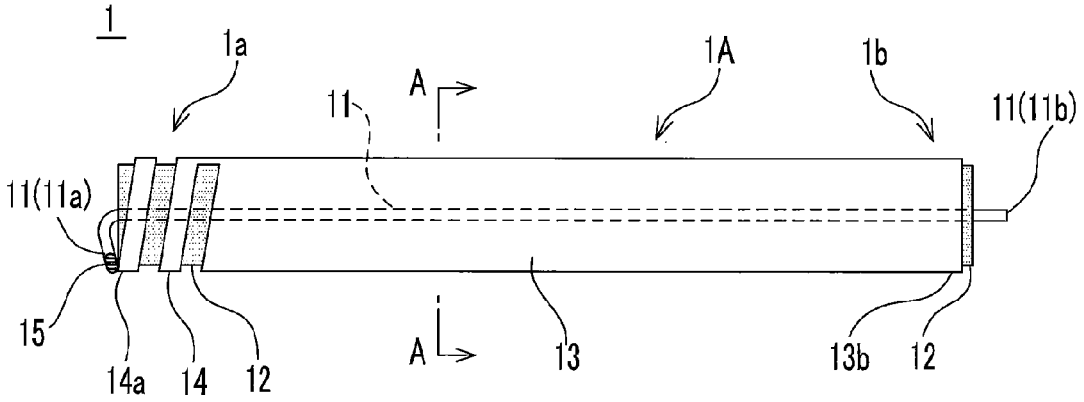
FIG. 2A is a front view of the antenna.
Figure 2B:
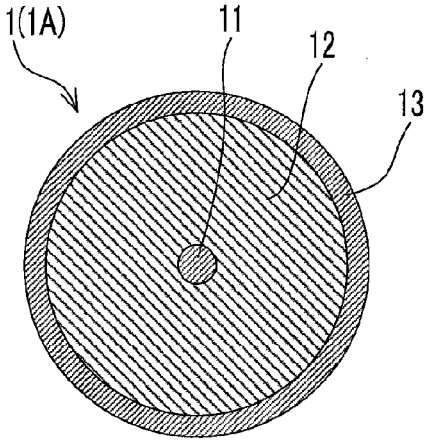
FIG. 2B is an enlarged cross sectional view taken along a line A-A in FIG. 2A.

The antenna 1 on the reader/writer 10 side includes a laminate body 1A configured so that a current (a current for supplying electric power to the antenna 1) is made to pass therethrough, thereby transmitting and receiving radio waves, as shown in FIG. 2A and FIG. 2B. This laminate body 1A is configured by including a conductor core 11 formed of an elongated conducting body, an insulator layer 12 formed of an insulating body which is disposed on the radially outer side of the conductor core 11, and a conductor layer 13 formed of a conducting body which is disposed on a radially outer side of the insulator layer 12.

The conductor core 11 has a linear body having a substantially circular shape or a polygonal shape in radial cross section, and may be configured as a linear body formed of a conducting body having a straight or curved shape. The conductor core 11 of the present embodiment is a conducting body that has a substantially circular shape in radial cross section, and has a straight shape along an axial direction.

The insulator layer 12 is a hollow body having a substantially circular shape or polygonal shape in radial cross section, and may be configured as a hollow body formed of an insulating body having a straight shape or a curved shape. The insulator layer 12 of the present embodiment is a hollow body having a substantially annular shape in radial cross section and has a straight shape along its axial direction. The center axis at the center in the radial direction of the insulator layer 12 is coincident with the center axis at the center in the radial direction of the conductor core 11. That is, the insulator layer 12 is coaxial with the conductor core 11 and is disposed on the radially outer side of the conductor core 11.

The conductor layer 13 may be configured as a hollow body having a substantially circular or polygonal shape in radial cross section and formed of a conducting body having a straight shape or a curved shape. The conductor layer 13 of the present embodiment is a hollow body having a substantially annular shape in radial cross section, and having a straight shape along its axial direction, that is a conducting body having a cylindrical shape. This conductor layer 13 may be formed, for example, by at least one selected from the group consisting of stainless steel, Cu, Ni, Al, Ag, Au, and Pd. The center axis at the center in the radial direction of the conductor layer 13 is coincident with the center axis at the center in the radial direction of the conductor core 11 and the insulator layer 12. That is, the conductor layer 13 is coaxial with the conductor core 11 and the insulator layer 12, and is disposed on the radially outer side of the insulator layer 12. The conductor layer 13 is provided with a conductor pattern 14.

The conductor pattern 14 is formed of a conducting body having such a shape that a power supply direction in which a current for power supply sent from the body part 2 of the reader/writer 10 flows becomes a direction from one end side 1*a* to another end side 1*b* in the axial direction or a direction opposite thereto. The conductor pattern 14 of the present embodiment is, for example, a conducting body having a spiral shape (winding shape) of a single wound or multiple wounds formed by providing a spiral shaped hole part on the one end side 1*a* in the axial direction of the conductor layer 13, and may be configured as a part of the conductor layer 13 (see FIG. 2A). The insulator layer 12 located radially inward of the conductor layer 13 (a lower layer) can be visually observed at the spiral shaped hole part provided on the one end side 1*a* in the axial direction of the conductor layer 13. The conductor pattern 14 of the present embodiment is formed only on a part in the axial direction of the conductor layer 13 and on the one end side 1*a* in the axial direction of the conductor layer 13. However, the conductor pattern 14 may be formed throughout the entire length in the axial direction of the conductor layer 13, that is, formed throughout from the one end side 1*a* to the other end side 1*b* in the axial direction of the conductor layer 13. The conductor pattern 14 of the present embodiment has a spiral shape formed by providing a spiral shaped hole part on the conductor layer 13, but is not necessarily limited thereto. For example, the shape of the conductor pattern 14 may be of a single annular shape or a plural annular shape by providing one or plural annular shaped hole parts in the conductor layer 13, in which the plural annular shape is formed by plural annular parts interconnected therebetween, or of a radially extending shape.

An end portion 14*a* on the one end side 1*a* of the conductor pattern 14 is connected to an end portion 11*a* on the one end side 1*a* of the conductor core 11. This connection part 15 is formed by welding or soldering the end portions 14*a* and 11*a* on the one end side 1*a* of the conductor pattern and the conductor core 11 (see FIG. 2A). Alternately, this connection part 15 may be formed by indirectly connecting the end portions 14*a* and 11*a* using a conductive member which enables current to flow therethrough.

The antenna 1 having the above configuration is connected to the matching circuit 3 (see FIG. 1). Specifically, the end portion 11*b* on the other end side 1*b* of the conductor core 11 and an end portion 13*b* on the other end side 1*b* of the conductor layer 13 are connected to the matching circuit 3. The matching circuit 3 is also connected to the body part 2. Thus, it is configured such that the current flow containing the information signal and the power supply signal sent from the body part 2 is inputted into and outputted from the antenna 1 via the matching circuit 3. Specifically, the current flows from the end portion 11*b* on the other end side 1*b* of the conductor core 11 to the end portion 11*a* on the one end side 1*a*, and then flows from the end portion 11*a* on the one end side 1*a* of the conductor core 11 to the end portion 14*a* on the one end side 1*a* of the conductor pattern 14, which is connected to this end portion 11*a*. Further, the current flows from the end portion 14*a* on the one end side 1*a* of the conductor pattern 14, heading to the other end side 1*b*, through the conductor pattern 14 to the end portion 13*b* of the end portion 11*b* of the conductor layer 13, and then heads to the matching circuit 3. That is, in order to enable the current to be inputted into and outputted from the antenna 1, the power supply is directed from the other end side 1*b* to the one end side 1*a* in the axial direction of the conductor core 11, and is directed from the one end side 1*a* to the other end side 1*b* in the axial direction of the conductor layer 13 (including the conductor pattern 14). The current of the present embodiment may be directed in the opposite direction, in which the current flows from the end portion 13*b* on the other end side 1*b* of the conductor layer 13 to the end portion 14*a* on the one end side 1*a* of the conductor pattern 14, and then flows through the end portion 11*a* on the one end side 1*a* of the conductor core 11 connected to this end portion 14*a* to the end portion 11*b* on the other end side 1*b*.

Now, the description is made for the characteristic features of the antenna 1 of the present embodiment with reference to FIG. 3 to FIG. 6.

Figure 3A:
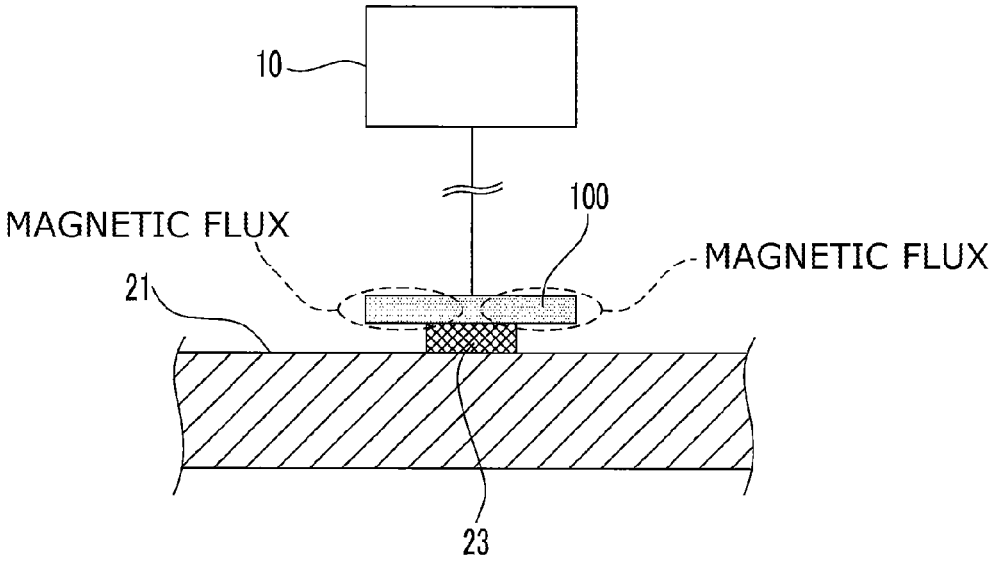
FIG. 3A is a conceptual diagram of a reader/writer provided with a conventional antenna, in which the conventional antenna is in abutting contact with or in proximity to an IC chip on a plane surface.
Figure 3B:
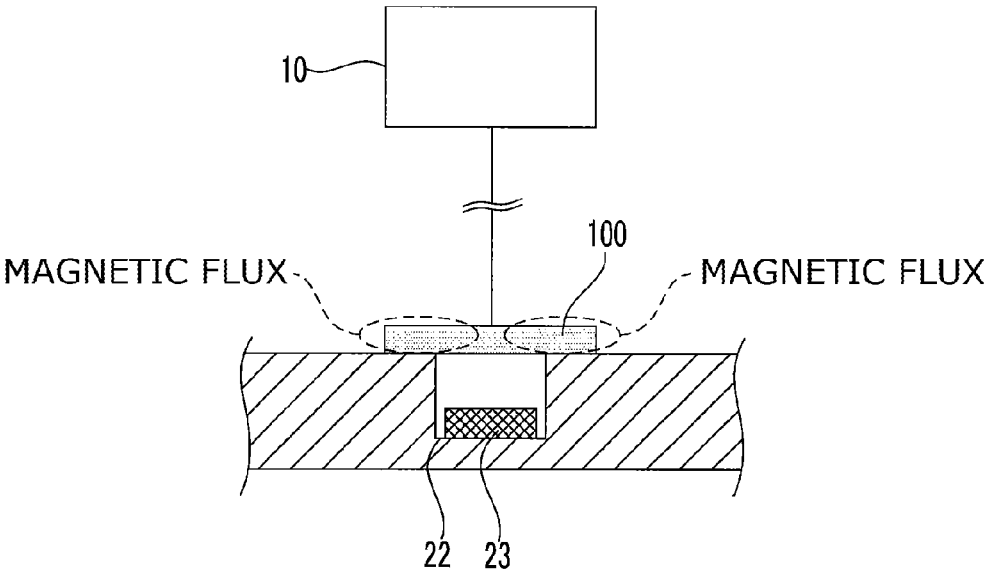
FIG. 3B is a conceptual diagram of a reader/writer provided with a conventional antenna, in which the conventional antenna is positioned with a distance away from an IC chip placed on a bottom surface of a small-sized concave portion, the distance being equivalent to the height of the concave portion.
Figure 4A:
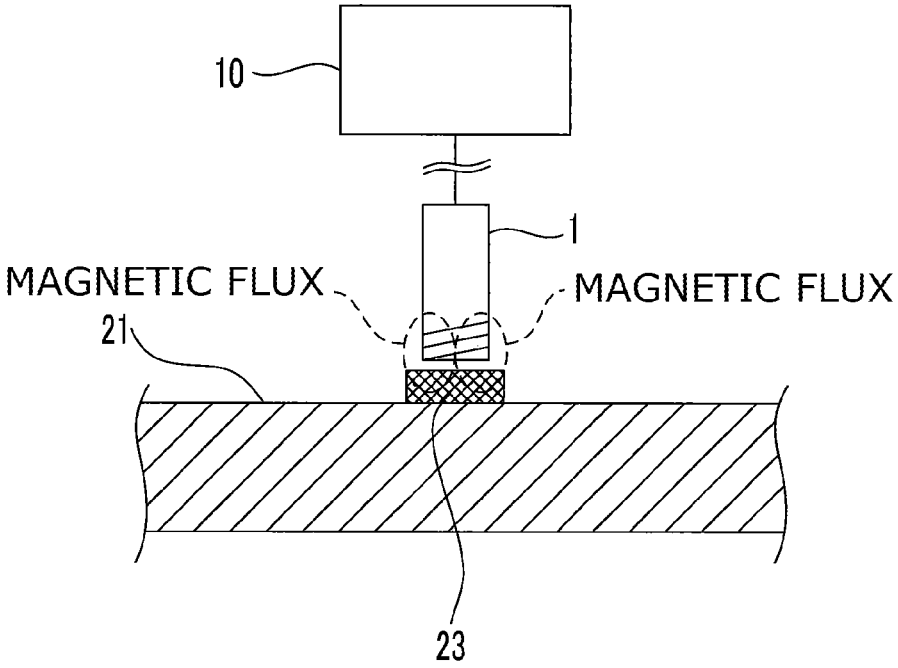
FIG. 4A is a conceptual diagram of a reader/writer provided with an antenna of the present invention, in which the antenna of the present invention is in abutting contact with or in proximity to an IC chip placed on a plane surface.
Figure 4B:
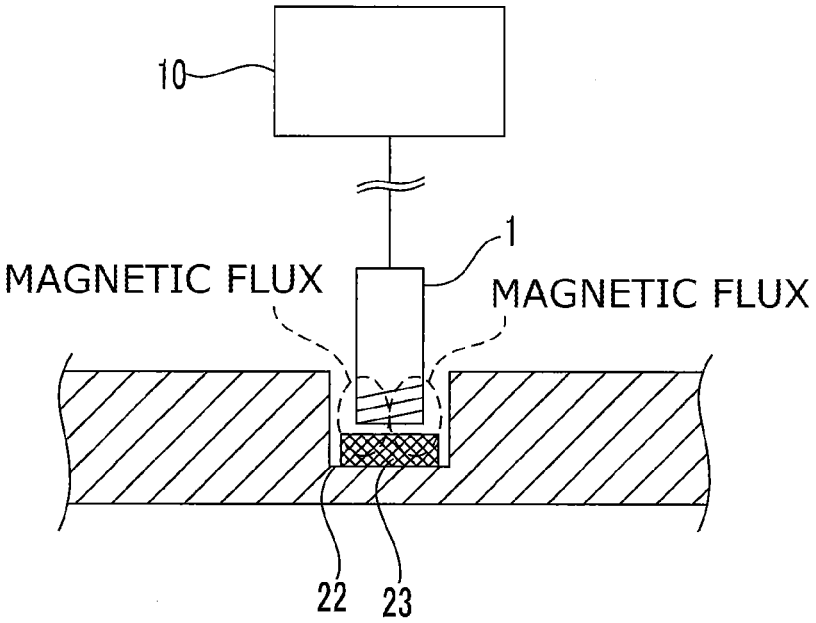
FIG. 4B is a conceptual diagram of a reader/writer provided with an antenna of the present invention, in which the antenna of the present invention is in abutting contact with or in proximity to an IC chip placed on a bottom surface of a small sized concave portion.

Experimental tests were conducted for the degree of change in standing wave frequency of an antenna, respectively in the state, as shown in FIG. 3A and FIG. 4A, where a small-sized IC chip 23 (having a size of about 0.5 to 10 mm) is placed on a top surface 21 of a flat-top metal body, and in the state, as shown in FIG. 3B and FIG. 4B, where the small-sized IC chip 23 is placed on a bottom surface 22 of a small-sized concave portion of a metal body having a concave shape (the groove width and the groove height of the concave portion being about 1 to 10 mm). The IC chip 23 does not mount a power source therein, and is an RFID tag of a passive type which transmits and receives radio waves using received radio waves as a power source. This RFID tag is provided with a transmitting and receiving antenna that performs wireless communication by transmitting and receiving radio waves between itself and the antenna 1 of the reader/writer 10.

Figure 5A:
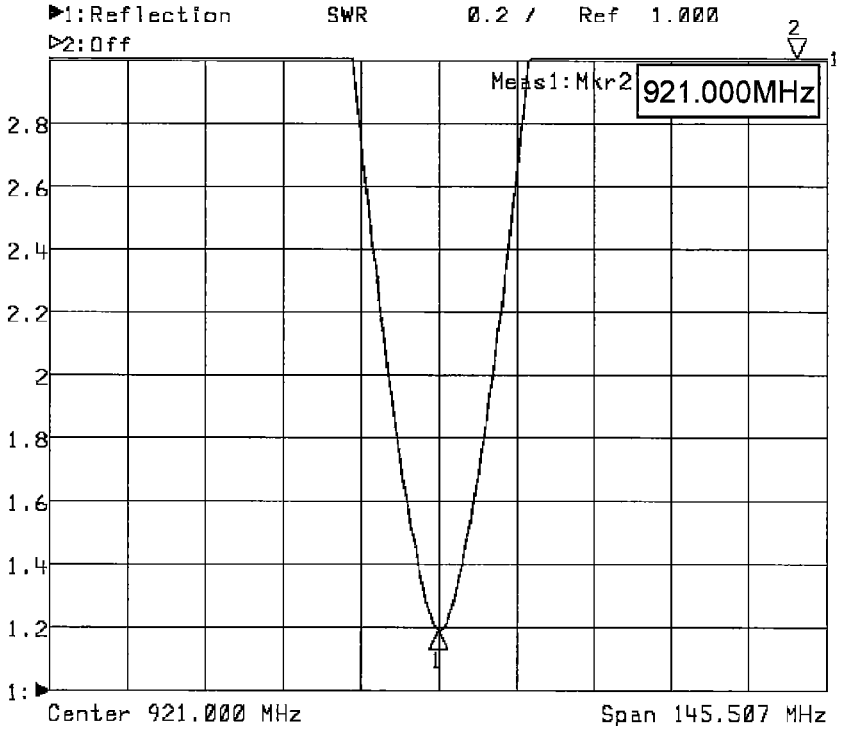
FIG. 5A is a view showing the relationship between a standing wave ratio and a standing wave frequency, and is a graph produced from the antenna of FIG. 3A, in which a vertical axis represents the standing wave ratio and a horizontal axis represents a frequency of the standing wave.
Figure 5B:
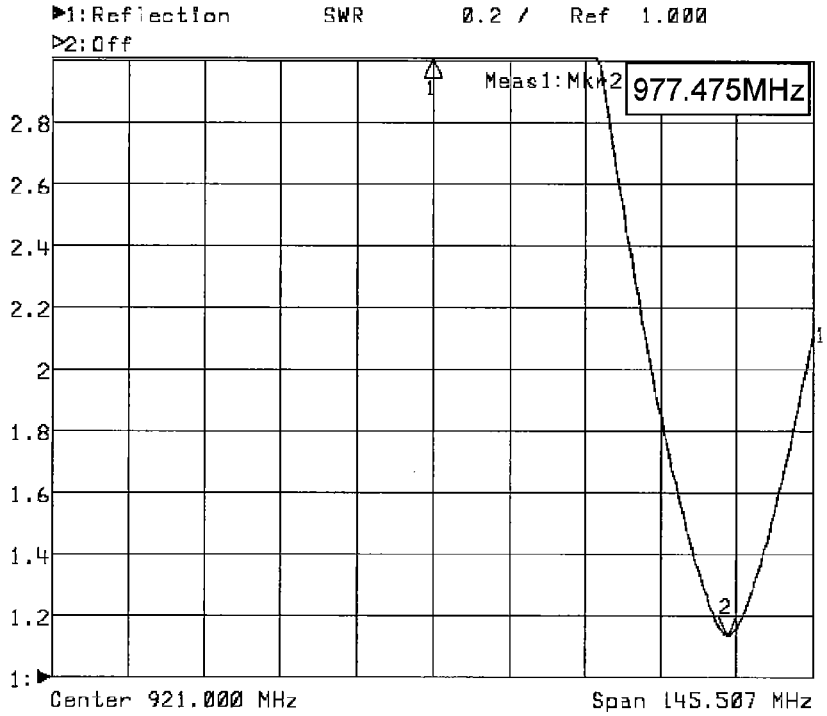
FIG. 5B is a view showing a relationship between a standing wave ratio and a standing wave frequency, and is a graph produced from the antenna of FIG. 3B.

A conventional antenna (an antenna being not sufficiently reduced in size with respect to the size of the concave portion) 100 had a standing wave basic frequency of about 921 MHz, as shown in FIG. 5A, in the case where the antenna 100 is in abutting contact with or in proximity to the IC chip 23, as shown in FIG. 3A. On the other hand, the antenna 100 had a standing wave basic frequency of about 977 MHz, as shown in FIG. 5B, in the case where the antenna 100 is separated from the IC chip 23 by a distance equivalent to the groove height of the concave portion, as shown in FIG. 3B. Thus, the conventional antenna 100 causes a large frequency shift of about 56 MHz as compared with the basic frequency in the state of FIG. 3A, in a wireless communication with the IC chip 23 placed on the concave portion of the metal body as shown in FIG. 3B, and thus the standing wave basic frequency was changed as the magnetic flux decreases. That is, since the magnetic field coupling becomes weak, the propagation distance of radio waves from the antenna 100, that is, the distance in which the communication can be made is shortened, which may cause troubles in wireless communication with the IC chip 23 placed in the concave portion of the metal body. For example, a power for driving the IC chip 23 cannot be obtained from the reader/writer 10. Further, communication disabling event or measurement disabling event may occur which depends on the basic frequency of the IC chip 23.

Figure 6A:
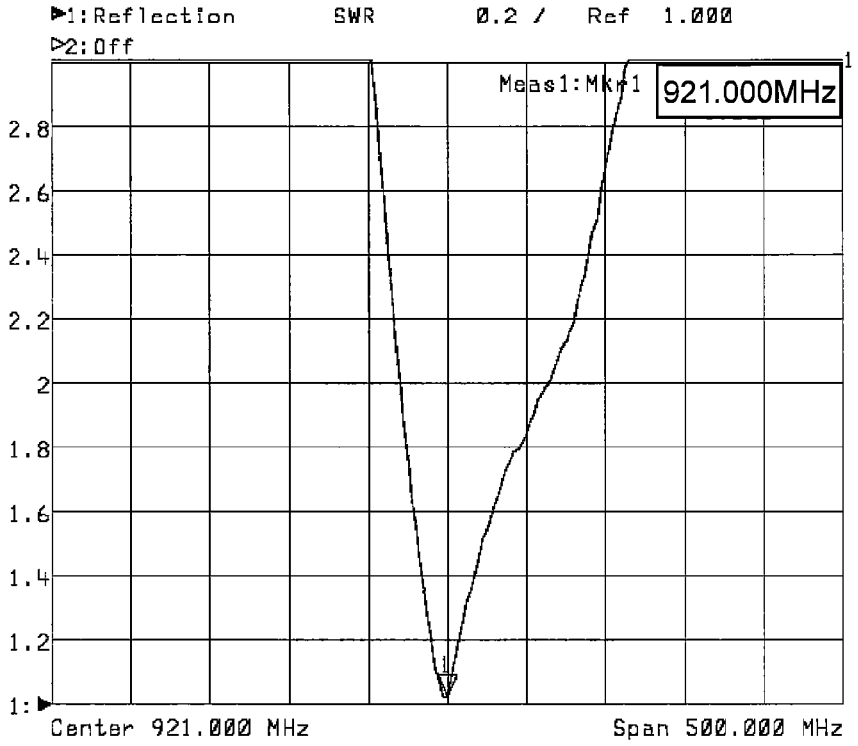
FIG. 6A is a view showing a relationship between a standing wave ratio and a standing wave frequency, and is a graph produced from the antenna of FIG. 4A.
Figure 6B:
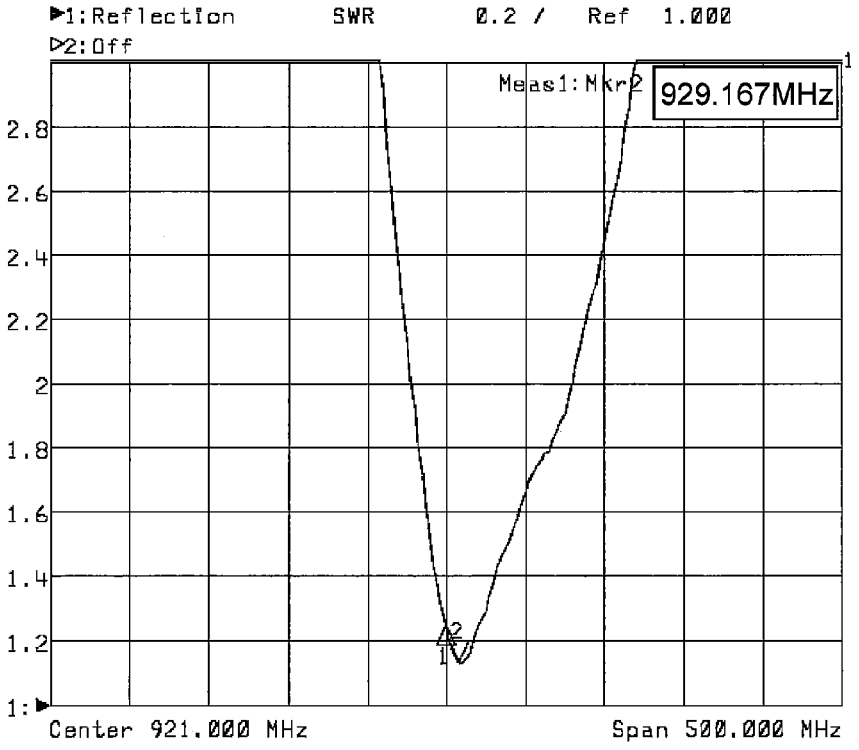
FIG. 6B is a view showing a relationship between a standing wave ratio and a standing wave frequency, and is a graph produced from the antenna of FIG. 4B.

The antenna 1 of the present embodiment had a standing wave basic frequency of about 921 MHz, as shown in FIG. 6A, in the case where the antenna 1 is located in abutting contact with or in proximity to the IC chip 23, as shown in FIG. 4A. On the other hand, the antenna 1 had a standing wave basic frequency of about 929 MHz, as shown in FIG. 6B, in the case where the antenna 1 is located in abutting contact with the IC chip 23 placed in the concave portion, as shown in FIG. 4B. Thus, the antenna 1 of the present embodiment does not substantially cause a frequency shift as compared with the basic frequency in the state of FIG. 4A, in wireless communication with the IC chip 23 placed in the concave portion of the metal body as shown in FIG. 4B, and the magnetic flux does not substantially change. Therefore, the antenna 1 of the present embodiment makes it possible to appropriately perform wireless communication with the small-sized IC chip 23 placed in the small-sized concave portion of the metal body.

Now, the description is made for a method for producing the antenna 1 of the present embodiment. The antenna 1 of the present embodiment can be produced by processing, for example, a semi-rigid cable.

Specifically, in production of the antenna 1, the conductor layer 13 of the laminate body 1A, which is constituted by the conductor core 11, the insulator layer 12 disposed on the radially outer side of the conductor core 11, and the conductor layer 13 disposed on the radially outer side of the insulator layer 12, is irradiated with laser (or laser beam) by a laser evaporation technique, thereby forming the conductor pattern 14 (a conductor patter forming step), and the conductor core 11 and the conductor pattern 14 are connected to each other (a connection step).

The conductor pattern forming step uses a laser device (irradiation means for irradiating laser) for carrying out the laser evaporation technique, a holding means for holding the laminate body 1A in a rotatable manner about its axis and an axially movable manner, and a turning means (e.g., a stepping motor including an encoder) that controls the detection of the position of the laminate body 1A in the circumferential direction and the rotating angle of the laminate body 1A. The laser device includes a light source for irradiation of laser, and a lens mechanism that changes the shape of the laser in the radial direction. For the light source, for example, a YAG laser (pulse laser having a wavelength of 1064 nm) light source may be used. For the lens mechanism, a combination of cylindrical lenses or a slit may be used. For example, the shape of laser in the radial direction may be changed from a circular shape to a rectangular shape. The laser device may be provided with a rotating mechanism that rotates the lens mechanism about the light axis of laser according to the angle (the inclination angle of the conductor layer 13 relative to a plane along the radial direction) of a certain shape (e.g., a spiral shape) of the conductor pattern 14, in order to smoothly and continuously form the conductor pattern 14.

In this conductor pattern forming step, laser is scanned on the insulator layer 12 with its outer circumferential surface on which the conductor layer 13 (specifically, a conductor film) is formed, thereby removing the conductor layer 13 with a desired portion left. Thus, the conductor pattern 14, which is a pattern of a certain shape (e.g., a spiral shape), is formed. Specifically, the laminate body 1A (specifically, the insulator layer 12) is rotated about the center axis continuously (or at a constant rotating speed), while being irradiated with laser, thereby continuously removing the conductor layer 13. A desired pattern position is not irradiated with laser so as to be left (not to be removed). Thus, a pattern of a certain shape (a spiral shape in the present embodiment) is formed.

More specifically, the laminate body 1A is held in a rotatable manner by the holding means. Then, the positional control of a pattern (a portion not irradiated with laser) is performed by the turning means controlling the position of the laminate body 1A (specifically, the insulator layer 12) in the circumferential direction and the rotating angle of the laminate body 1A, while the concave layer 13 is irradiated with laser from the laser device along the normal line on the radial direction side surface to be oriented perpendicular to the center axis of the conductor layer 13. In the positional control for the pattern, control is made so that feeding amount of the laminate body 1A with respect to one direction along the axial direction is controlled to be equal to or smaller than the laser diameter, while the laminate body 1A is rotated one turn (one rotation) at a certain rotating speed with respect to the circumferential direction (or rotational direction), to thereby allow an area irradiated with laser to form a spiral shape.

The rotating speed, that is, the unit angle of rotation is not necessarily limited, but may be arbitrarily controlled to be 0.1 degrees, or higher or smaller than 0.1 degrees. However, when the unit angle of rotation is set to be 0.1 degrees or higher (e.g., 0.25 degrees), it is preferable that the turning means be provided with a deceleration device (gear head).

In the connection step, the end portion 11*a* on the one end side 1*a* of the conductor core 11, which is located on the radially center side of the insulator layer 12 and the end portion 14*a* on the one end side 1*a* of the conductor pattern 14 formed in the conductor pattern forming step are connected to each other by welding or soldering. The connecting method is not necessarily limited to a specific one, provided that the connection does not interfere power distribution. The antenna 1 produced in the above manner functions as a transmitting and receiving antenna of the reader/writer 10 by connecting the end portion 11*b* on the other end side 1*b* of the conductor core 11 and the end portion 13*b* on the other end side 1*b* of the conductor layer 13 to the matching circuit 3.

As described above, the antenna 1 of the present embodiment includes the laminate body 1A configured so that a current is made to flow therethrough, thereby transmitting and receiving radio waves, the laminate body 1A including: the conductor core 11 formed of an elongated conducting body; the insulator layer 12 formed of an insulating body disposed on the radially outer side of the conductor core 11; and the conductor pattern 14 disposed on the radially outer side of the insulator layer 12 and formed of a conducting body having such a spiral shape that a power supply direction in which the current flows becomes any one of a direction from the one end side 1*a* to the other end side 1*b* in the axial direction and a direction opposite thereto, wherein the conductor pattern 14 is the conductor layer 13 formed of a conducting body disposed on the radially outer side of the insulator layer 12, and wherein the end portions 11*a* and 14*a* on the one end side 1*a* of the conductor core 11 and the conductor pattern 14 are connected to each other in such a manner that a current is made to flow in a direction from the conductor core 11 to the conductor pattern 14 or in a direction opposite thereto so as to allow its power supply direction to coincide with any one of the aforesaid directions.

The thus configured antenna 1 can be easily reduced in size because it employs a simple lamination structure formed of the laminate body 1A with the conductor pattern 14 disposed as the conductor layer 13 therein. Further, since the conductor core 11 and the conductor pattern 14 are connected to each other in the antenna 1, the magnetic field coupling becomes dominant compared with a so-called open type where both members are not connected. Thus, it is possible to increase the propagation distance of radio waves, that is, the distance in which the communication can be made, while suppressing influences such as lowering the transmitting efficiency of radio waves due to the surrounding matters or substances, and hence achieve appropriate communication.

A method for producing the antenna 1 of the present embodiment includes: a conductor pattern forming step of providing the conductor pattern 14 having such a spiral shape that a power supply direction, in which a current for power supply flows becomes any one of a direction from the one end side 1*a* to the other end side 1*b* in an axial direction and a direction opposite thereto, by irradiating the conductor layer 13 of the laminate body 1A with laser by the laser evaporation technique, the laminate body 1A being formed of the conductor core 11 formed of an elongated conducting body, the insulator layer 12 formed of an insulating body disposed on the radially outer side of the conductor core 11, and the conductor layer 13 formed of a conducting body disposed on the radially outer side of the insulator layer 12; and a connection step of connecting the end portions 11*a* and 14*a* on the one end side 1*a* of the conductor core 11 and the conductor pattern 14 to each other in such a manner that a current is made to flow in a direction from the conductor core 11 to the conductor pattern 14 or in a direction opposite thereto so as to allow its power supply direction to coincide with the aforesaid direction.

The thus configured method for producing the antenna 1 makes it possible to easily form the conductor pattern 14 on the conductor layer 13 of the laminate body 1A by the laser evaporation technique in the conductor pattern forming step, and hence easily reduce the size of the antenna 1. Further the thus configured method for producing the antenna 1 makes it possible to enable the antenna 1 to function as a short-end antenna by connecting the conductor core 11 and the conductor pattern 14 to each other in the connection step. Such a short-end antenna makes its magnetic field coupling dominant compared with a so-called open end type where the conductor core 11 and the conductor pattern 14 are not connected to each other, and therefore makes it possible to increase the propagation distance of radio waves, that is, the distance in which the communication can be made, while suppressing influences such as lowering the transmitting efficiency of radio waves due to the surrounding matters or substances, and hence achieve appropriate communication.

In summary, according to the thus configured antenna 1 and production method, since a simple lamination structure, namely the laminate body 1A is employed, it is possible to easily form the conductor pattern 14 on the conductor layer 13 of the laminate body 1A by the laser evaporation technique, and hence easily reduce the size of the antenna 1. Also, connecting the conductor core 11 with the conductor pattern 14 makes it possible to enable the antenna 1 to function as a short-end antenna. Such antenna 1 makes its magnetic field coupling dominant compared with a so-called open end type where the conductor core 11 and the conductor pattern 14 are not connected to each other, and therefore makes it possible to increase the propagation distance of radio waves, that is, the distance in which the communication can be made, while suppressing influences such as lowering the transmitting efficiency of radio waves due to the surrounding matters or substances, and hence achieve appropriate communication. Further, the antenna 1, in which the conductor core 11 and the conductor pattern 14 are connected to each other, can reduce consumption of electric power for resonating at the matching circuit 3, and reduce the number of spirals (or the number of windings or the number of patterns) of a spiral shape of the conductor pattern 14.

In the method for producing the antenna 1 of the present embodiment, laser irradiation by the laser evaporation technique in the conductor pattern forming step is configured so that the conductor layer 13 is irradiated with laser along the nominal line on the radial direction side surface, while the laminate body 1A is continuously rotated about its axis.

According to the thus configured method for producing the antenna 1, the radial direction side surface of the conductor layer 13 is irradiated with laser in a perpendicular direction while the laminate body 1A is continuously rotated about the axis of the conductor core 11, thereby making it possible to eliminate fluctuation in pattern width (or hole width due to laser irradiation marks) and thereby make the pattern width constant, and hence accurately form the conductive pattern. Thus, it is possible to suppress lowering of the antenna performance.

The present invention is not necessarily limited to the above embodiment, and can be subjected to various modifications within the gist of the present invention.

Figure 7:
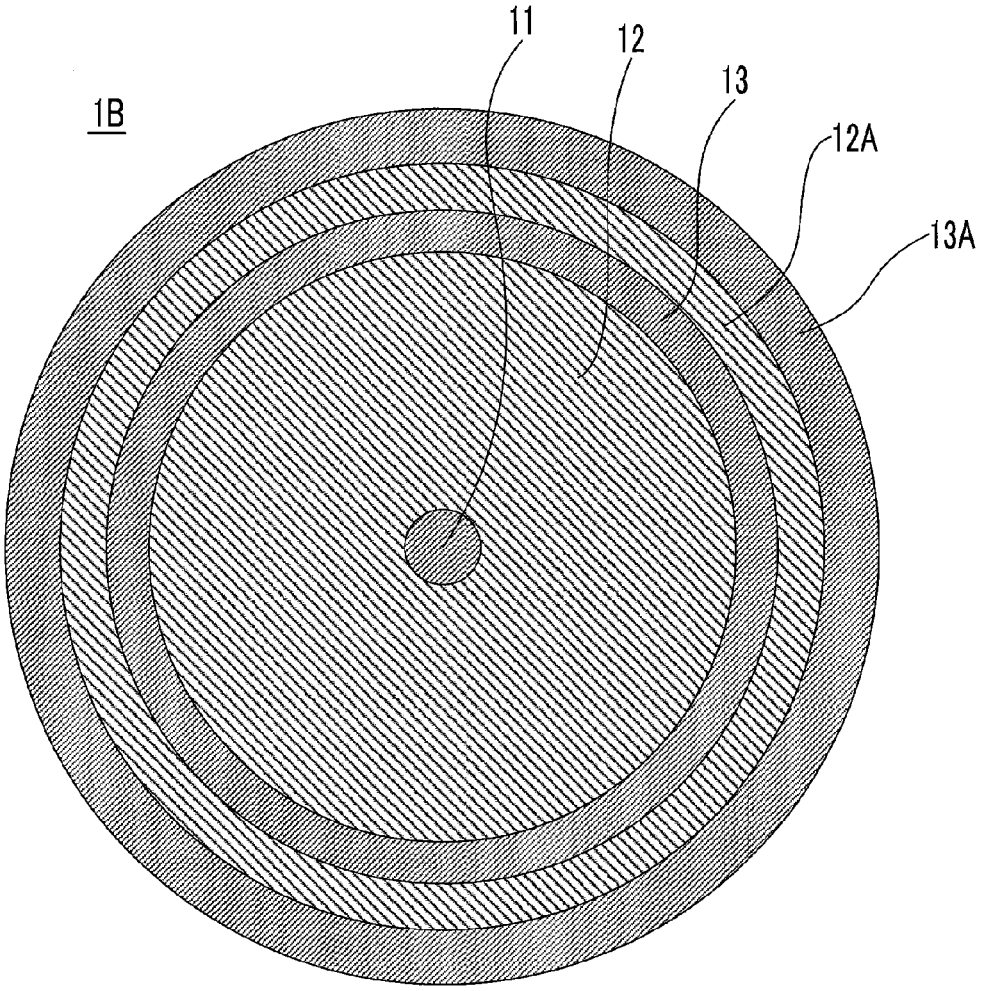
FIG. 7 is a cross sectional view taken in the radial direction of a laminate body of an antenna of another embodiment of the present invention.

As shown in FIG. 7, an antenna according to another embodiment of the present invention may include a laminate body 1B that is configured by including a conductor core 11 formed of an elongated conducting body, an inside insulator layer 12 formed of an insulating body disposed on the radially outer side of the conductor core 11, an inside conductor layer 13 formed of an insulating body disposed on the radially outer side of the inside conductor layer 12, an outside insulator layer 12A formed of a conductor body disposed on the radially outer side of the inside conductor layer 13, and an outside conductor layer 13A formed of a conducting body disposed on the radially outer side of the outside insulator layer 12. For example, the laminate body 1B may be formed by forming the inside conductor layer 13 which is a metal thin film on the inside insulator layer 12, and disposing the outside conductor layer 13A which is a metal thin film on the inside conductor layer 13 via the outside insulator layer 12A. The inside conductor layer 13 or the outside conductor layer 13A may be formed by a conventional film forming method, such as electroless plating or sputter deposition. The inside insulator layer 12 or the outside insulator layer 12A is preferably formed by a synthetic resin insulating body, such as Teflon (trademark), styrene, or polyvinyl chloride, taking into account the adhesiveness to the inside conductor layer 13 or the outside conductor layer 13A; however a material is not necessarily limited to a specific one, provided that the material can provide insulation.

In this laminate body 1B, an inside conductor pattern forms a spiral shape (a certain shape enabling the power supply direction in which the current flows becomes a direction from one end side to the other end side in the axial direction or a direction opposite thereto) on one end on one end side of the inside conductor layer 13, and an end portion on the one end side of the inside conductor pattern and an end portion on the one end side of the conductor core 11 are connected to each other. Further, an outside conductor pattern having a spiral shape which is the same as or substantially the same as the shape of the inside conductor pattern is formed at an end portion on the one end side of the outside conductor layer 13A which corresponds to the radially outer side of the inside conductor pattern. It is to be noted that the outside conductor pattern is disposed on the radially outer side of the inside conductor pattern via the outside insulator layer 12A, so that the length along the circumferential direction of the outside conductor pattern (pattern length) is longer than the length along the circumferential direction of the inside conductor pattern.

Thus, according to the thus configured antenna, two different inductances are formed by the inside conductor pattern and the outside conductor pattern. Since the outside conductor pattern works on low frequencies, while the inside conductor pattern works on high frequencies, so that the antenna functions as a broadband antenna by synthesizing the two patterns. According to the thus configured antenna, the laminate body 1B includes the outside conductor pattern formed of a conducting body having a certain shape which is the same as or substantially the same as the shape of the inside conductor pattern, so that radio waves to be transmitted and received are amplified by the action of the electromagnetic fields of the inside conductor pattern and the outside conductor pattern and such amplified radio waves can be transmitted and received. Further, the thus configured antenna, which employs a simple laminate structure, namely the laminate body 1B formed by disposing the inside conductor pattern and the outside conductor pattern, respectively as the inside conductor layer 13 and the outside conductor layer 13A, can be easily reduced in size.

A method for producing the antenna of the other embodiment includes: an outside conductor pattern forming step of providing the outside conductor pattern having such a spiral shape that a power supply direction in which a current for power supply flows becomes a direction from one end side to the other end side in an axial direction or a direction opposite thereto, by irradiating the outside conductor layer 13A of the laminate body 1B with laser by the laser evaporation technique, the laminate body 1B including the conductor core 11, the inside insulator layer 12 formed of an insulating body disposed on the radially outer side of the conductor core 11, the inside conductor layer 13 formed of an insulating body disposed on the radially outer side of the inside conductor layer 12, the outside insulator layer 12A formed of an insulating body disposed on the radially outer side of the inside conductor layer 13, and the outside conductor layer 13A formed of a conducting body disposed on the radially outer side of the outside insulator layer 12; an inside conductor pattern forming step of providing the inside conductor layer 13 with an inside conductor pattern having a shape which is the same as or substantially the same as the spiral shape of the outside conductor pattern by removing a part of the outside insulator layer 12A and a part of the inside conductor layer 13, respectively, using wet etching with the outside conductor pattern as a mask; and a connection step of connecting the end portions on the one end side of the conductor core 11 and the inside conductor pattern to each other in such a manner that a current is made to flow in a direction from the conductor core 11 to the inside conductor pattern or in a direction opposite thereto so as to allow its power supply direction to coincide with a direction of a current which is made to flow for power supply in a direction from the one end side to the other end side in the axial direction of the inside conductor pattern or in a direction opposite thereto. Laser irradiation by the laser evaporation technique in the outside conductor pattern forming step is configured so that the outside conductor layer 13A is irradiated with laser along the nominal line on the radial direction side surface, while the laminate body 1B is continuously rotated about the axis of the conductor core 11.

According to the thus configured method for producing the antenna, the outside conductor pattern can be easily formed on the outside conductor layer 13A of the laminate body 1B by the laser evaporation technique in the outside conductor pattern forming step, and the inside conductor pattern can be easily formed on the inside conductor layer 13 by the wet etching with the outside conductor pattern as a mask in the inside conductor pattern forming step. Thus, the antenna can be easily reduced in size. Also, according to the method for producing the antenna, the antenna can be allowed to function as a short-end antenna by connecting the conductor core 11 with the inside conductor pattern in the connection step.

In the above one embodiment and other embodiment, the description was made for the case where the laminate body 1A and the laminate body 1B each are continuously rotated about its axis during laser irradiation by the laser evaporation technique. Alternately, the laser device may be rotated so as to irradiate the laminate body 1A or the laminate body 1B with laser along the nominal line on its radial direction side surface.

According to the thus configured method for producing the antenna, the radial direction side surface of the conductor layer or the outside conductor layer is irradiated with laser in a perpendicular direction, while the laser irradiation means for irradiating laser is continuously rotated about the axis of the conductor core, thereby making it possible to eliminate fluctuation in width of a laser irradiation mark and hence make the width constant. Thus, it is possible to suppress lowering of the antenna performance.

REFERENCE SIGNS LIST

1 Antenna
1A, 1B Laminate Body
1*a* One End Side
1*b* Other End Side
2 Body Part
3 Matching Circuit
10 Reader/Writer
11 Conductor Core
12 Insulator Layer (Inside Insulator Layer)
12*a* Outside Insulator Layer
13 Conductor Layer (Inside Conductor Layer)
13A Outside Conductor Layer
14 Conductor Pattern
15 Connection Part
21 Top Surface of Metal Body
22 Bottom Surface of Concave portion of Metal Body
23 Chip
100 Conventional Antenna

The invention claimed is:

1. An antenna comprising a laminate body configured so that a current is made to flow therethrough, thereby transmitting and receiving radio waves, the laminate body comprising:

a conductor core formed of an elongated conducting body;

an insulator layer formed of an insulating body disposed on a radially outer side of the conductor core; and a conductor layer formed of a conducting body which is disposed on a radially outer side of the insulator layer and being provided with a conductor pattern having such a shape that a power supply direction in which the current flows becomes a direction from one end side to an other end side in an axial direction of the conductor core or a direction opposite thereto, wherein the conductor pattern is configured to extend along an outer circumferential surface of the insulator layer in spiral form and having a leading end disposed on the outer circumferential surface of the insulator layer, and wherein one end in the axial direction of the conductor core and the leading end of the conductor pattern are connected to each other in such a manner that a current is made to flow in a direction from the conductor core to the conductor pattern or in a direction opposite thereto so as to allow its power supply direction to coincide with the aforesaid direction.

2. The antenna according to claim 1, wherein the laminate body comprises an outside insulator layer formed of an insulating body disposed on a radially outer side of the conductor pattern, and an outside conductor pattern disposed on a radially outer side of the outside insulator layer and formed of a conducting body having a certain shape which is the same as or substantially the same as the shape of the conductor pattern, and wherein the outside conductor pattern is a conductor layer formed of a conducting body disposed on the radially outer side of the outside insulating body.

3. The antenna according to claim 1, wherein the conductor core has a shape having one end in the axial direction thereof, the one end being bent toward a radially outer side of the insulator layer.

4. The antenna according to claim 3, wherein the laminate body comprises an outside insulator layer formed of an insulating body disposed on a radially outer side of the conductor pattern, and an outside conductor pattern disposed on a radially outer side of the outside insulator layer and formed of a conducting body having a certain shape which is the same as or substantially the same as the shape of the conductor pattern, and wherein the outside conductor pattern is a conductor layer formed of a conducting body disposed on the radially outer side of the outside insulating body.

5. A method for producing an antenna comprising:

a conductor pattern forming step of providing a conductor layer of a laminate body with a conductor pattern having such a shape that a power supply direction in which a current for power supply flows becomes a direction from one end side to an other end side in an axial direction or a direction opposite thereto, by irradiating the conductor layer with laser by a laser evaporation technique, the laminate body comprising a conductor core having an elongated conducting body, an insulator layer formed of an insulating body disposed on a radially outer side of the conductor core, and the conductor layer formed of a conducting body disposed on a radially outer side of the insulator layer, the conductor pattern being configured to extend along an outer circumferential surface of the insulator layer in spiral form and having a leading end disposed on the outer circumferential surface of the insulator layer; and a connection step of connecting one end in the axial direction of the conductor core and the leading end of the conductor pattern to each other in such a manner that a current is made to flow in a direction from the conductor core to the conductor pattern or in a direction opposite thereto so as to allow its power supply direction to coincide with the aforesaid direction.

6. The method for producing an antenna according to claim 5, wherein the conductor layer of claim 5 is irradiated with laser along a nominal line on a radial side surface, while an irradiating means for irradiating laser or a laminate body is continuously rotated about an axis of a conductor core during laser irradiation using the laser evaporation technique in the conductor pattern forming step of claim 5.

7. A method for producing an antenna comprising:

an outside conductor pattern forming step of providing an outside conduction layer with an outside conductor pattern having such a shape that a power supply direction in which a current for power supply flows becomes a direction from one end side to an other end side in an axial direction or a direction opposite thereto, by irradiating the outside conductor layer with laser by a laser evaporation technique, a laminate body comprising a conductor core formed of an elongated conducting body, an inside insulator layer formed of an insulating body disposed on a radially outer side of the conductor core, an inside conductor layer formed of an insulating body disposed on a radially outer side of the inside conductor layer, an outside insulator layer formed of an insulating body disposed on a radially outer side of the inside conductor layer, and the outside conductor layer formed of a conducting body disposed on a radially outer side of the outside insulator layer, the outside conductor pattern being configured to extend along an outer circumferential surface of the outside insulator layer in spiral form and having a leading end disposed on the outer circumferential surface of the conductor core;

an inside conductor pattern forming step of providing the inside conductor layer with an inside conductor pattern having a shape which is the same as or substantially the same as the shape of the outside conductor pattern by removing a part of the outside insulator layer and a part of the inside conductor layer, respectively, using wet etching with the outside conductor patter as a mask, the inside conductor pattern being configured to extend along an outer circumferential surface of the inside insulator layer and having a leading end disposed on the outer circumferential surface of the inside insulator layer; and a connection step of connecting one end in the axial direction of the conductor core and the leading end of the inside conductor pattern to each other in such a manner that a current is made to flow in a direction from the conductor core to the inside conductor pattern or in a direction opposite thereto so as to coincide with a direction of a current which is made to flow for power supply from the one end side to the other end side in the axial direction of the inside conductor pattern.

8. The method for producing an antenna according to claim 7, wherein the outside conductor layer of claim 7 is irradiated with laser along a nominal line on a radial side surface, while an irradiating means for irradiating laser or a laminate body is continuously rotated about an axis of a conductor core during laser irradiation using the laser evaporation technique in the outside conductor pattern forming step of claim 7.

* * * * *